US009475110B2

(12) United States Patent
Derry et al.

(10) Patent No.: US 9,475,110 B2
(45) Date of Patent: Oct. 25, 2016

(54) INTEGRATED DOOR/DRAWER HANDLE

(71) Applicant: THE DELFIELD COMPANY, LLC, Mt. Pleasant, MI (US)

(72) Inventors: Nick Richard Derry, Mt. Pleasant, MI (US); Janice M. Jaferian, Palm Harbor, FL (US)

(73) Assignee: THE DELFIELD COMPANY, LLC, Mt. Pleasant, MI (US)

( * ) Notice: Subject to any disclaimer, the term of this patent is extended or adjusted under 35 U.S.C. 154(b) by 0 days.

(21) Appl. No.: 14/316,866

(22) Filed: Jun. 27, 2014

(65) Prior Publication Data

US 2015/0376914 A1 Dec. 31, 2015

(51) Int. Cl.

| | |
|---|---|
| ***B21D 5/00*** | (2006.01) |
| ***A47B 95/02*** | (2006.01) |
| ***B21D 53/74*** | (2006.01) |

(52) U.S. Cl.

CPC ..... *B21D 5/00* (2013.01); *A47B 95/02* (2013.01); *B21D 53/74* (2013.01); *A47B 2095/027* (2013.01); *Y10T 16/458* (2015.01)

(58) Field of Classification Search

CPC ..... A47B 95/02; A47B 2095/024; A47B 2095/027; E06B 5/006; Y10T 16/44; Y10T 16/458; Y10T 16/462; Y10T 29/49906; E05B 1/06; E05B 1/0015; B21D 5/00; B21D 53/74

USPC ..... 16/110.1, 412, 415; 72/379.2; 29/469.5; 312/348.6

See application file for complete search history.

(56) References Cited

U.S. PATENT DOCUMENTS

| | | | | | |
|---|---|---|---|---|---|
| 2,653,851 | A | * | 9/1953 | Davidson | A47B 95/02 16/412 |
| 3,294,463 | A | * | 12/1966 | Kafferlin | A47B 95/02 16/416 |
| 3,819,247 | A | | 6/1974 | Evans | |
| 4,478,465 | A | * | 10/1984 | Sulcek | B30B 9/3003 312/183 |
| 4,662,114 | A | | 5/1987 | Suttles | |
| 4,861,123 | A | * | 8/1989 | Russell | A47B 88/04 312/330.1 |
| 2013/0042434 | A1 | | 2/2013 | Rothwell et al. | |

FOREIGN PATENT DOCUMENTS

GB 2482527 A 2/2012

OTHER PUBLICATIONS

Chinese Office Action dated Oct. 8, 2014 for Chinese application No. 201430093265.1.

International Search Report dated Nov. 14, 2014 from corresponding PCT/US2014/044473, pp. 4.

International Written Opinion dated Nov. 14, 2014 from corresponding PCT/US2014/044473, pp. 21.

* cited by examiner

*Primary Examiner* — William Miller

(74) *Attorney, Agent, or Firm* — Ohlandt, Greeley, Ruggiero & Perle, L.L.P.

(57) ABSTRACT

The present disclosure provides a single piece sheet metal design incorporating two individual hem bend configurations forming the door/drawer front, a functional door/drawer handle, and a gasket protecting barrier.

20 Claims, 5 Drawing Sheets

INTEGRATED DOOR/DRAWER HANDLE

BACKGROUND OF THE DISCLOSURE

1. Field of the Disclosure

The present disclosure relates to an assembly having a handle integrated into a front panel of door or drawer.

2. Field of the Related Art

Typical foodservice door or drawer assemblies require additional components to achieve a "handle" for opening, closing, or generally changing the position of the door or drawer. These handles can vary from simple plastic or other non-steel components snapped into a door or drawer front panel or others purchased or formed and secured to the door or drawer front panel by mechanical fasteners or welding.

Typical handles in the food service industry have recesses, corners, coves, or similar crevasses to clean. Silicone may be required to close these areas and over time re-applying silicone is required. Commonly, this is neglected or forgotten about and does not happen, so food particles become lodged in the areas. Over time, these food particles begin to decompose and create sanitary risks.

Typical handle designs are vulnerable to a high probability of breakage. For example, carts that are pushed through a restaurant kitchen can collide with protruding handles or crush flush plastic handles.

Additionally, some handle designs provide a less than adequate gripping capability. Handle position, i.e., height above the floor, as well as depth of gripping area are both causes for this. Doors with handles of less gripping capability may require an "eagle claw" gripping method to open a door. Exposed door gaskets in this gripping area are frequently damaged, or at minimum soiled and require additional cleaning.

Accordingly, there is a need for a handle which overcomes the deficiencies of conventional handle designs.

BRIEF SUMMARY OF THE PRESENT DISCLOSURE

The present disclosure provides an assembly having a handle integrated into a front panel or door which eliminates the need for additional parts and purchased components. Because the front panel and handle are one integrated piece, there is nothing to be exposed to the dangers of a busy kitchen, such as injury to a person or damage to the handle.

The present disclosure provides an assembly having a handle integrated into a front panel which makes cleaning easier and eliminates the possibility of food particles and other debris from becoming lodged in seams and crevices. Cleaning the front panel and handle becomes much easier from a user maintenance standpoint, especially when used in busy environments with high levels of activity.

The present disclosure provides an assembly having a flat continuous front surface which can be easily wiped clean and a "U" shaped continuous trough which is open at both ends and easily wipeable. Both areas can utilize the same type of restaurant equipment cleaner.

The present disclosure provides an assembly having a handle integrated into a front panel with a recessed gripping area suitable for any person, no matter the person's size because a comfortable grip location can be found anywhere along the entire length of the integrated door/drawer handle.

Wet foam insulation leakage, which is a manufacturing complication, is lessened by the assembly of the present disclosure. Eliminating seams in the front assembly eliminate possible areas for foam to escape during the insulation process. Leaked wet foam adheres and hardens to the front exterior and requires additional time for removal.

The present disclosure also provides for a rear closed hem of the handle that affords gasket protection. The gasket is further protected from hands as well as protection from foreign matter spilled or spattered on the front of the hem. As used herein, a hem is the result of folding metal back on itself. Hemming is a bending operation that bends and folds an edge of sheet metal back upon itself. Hemming conceals the sharp edge of sheet metal.

The present disclosure provides for an integrated door/drawer and handle that is symmetrical about either a horizontal or vertical axis. Thus, the door/drawer is capable of being mounted to a fixture such that it can be opened left, right, up, or down.

An assembly having a handle integrated into a front panel of door or drawer is constructed from a single piece of sheet metal and has a front panel, a handle, a trough, and a gasket barrier. The handle is formed by a tear drop hem. The gasket barrier is formed by a closed hem. The trough is formed by the area between the handle and the gasket barrier.

DETAILED DESCRIPTION OF THE DISCLOSURE

Figure 1:
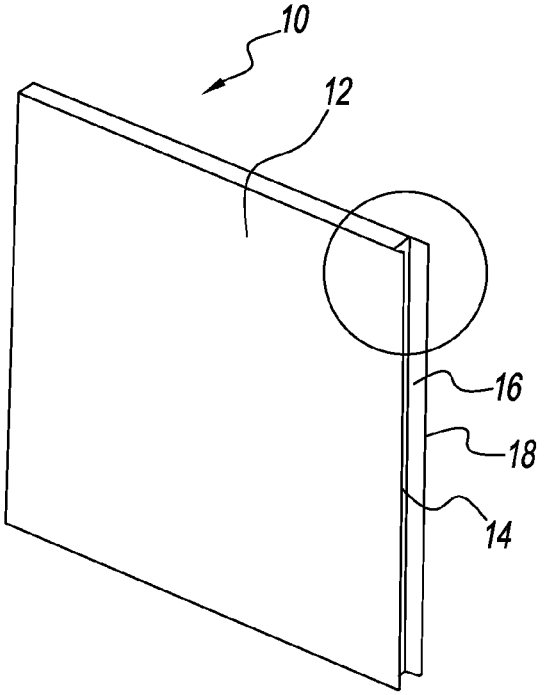
FIG. 1 is a top down perspective view of the integrated door and handle assembly of the present disclosure.
Figure 1A:
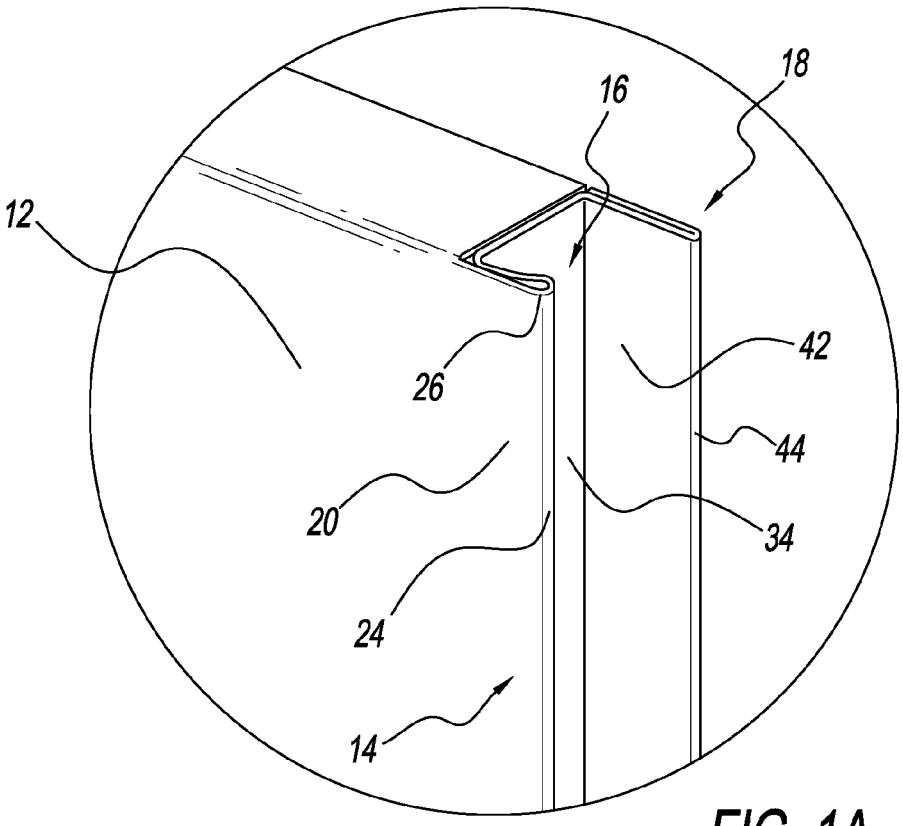
FIG. 1*a* is a detail view of the integrated door and handle of FIG. 1.
Figure 2:
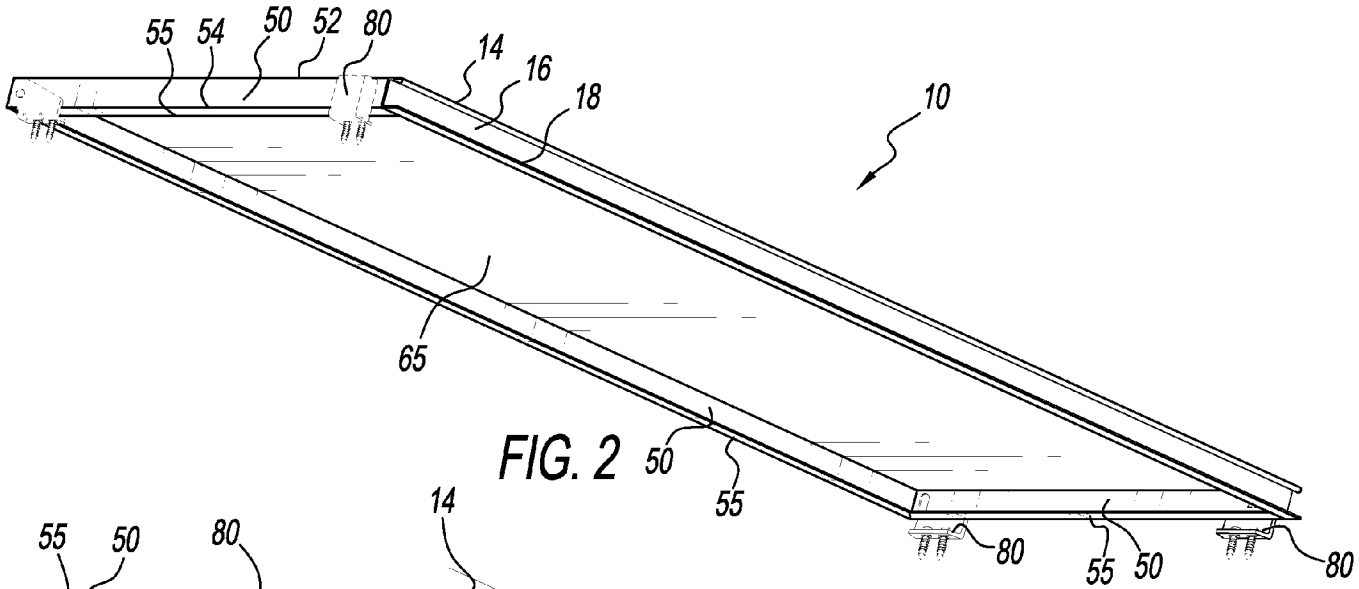
FIG. 2 is bottom up perspective view of the integrated door and handle of FIG. 1.
Figure 3:
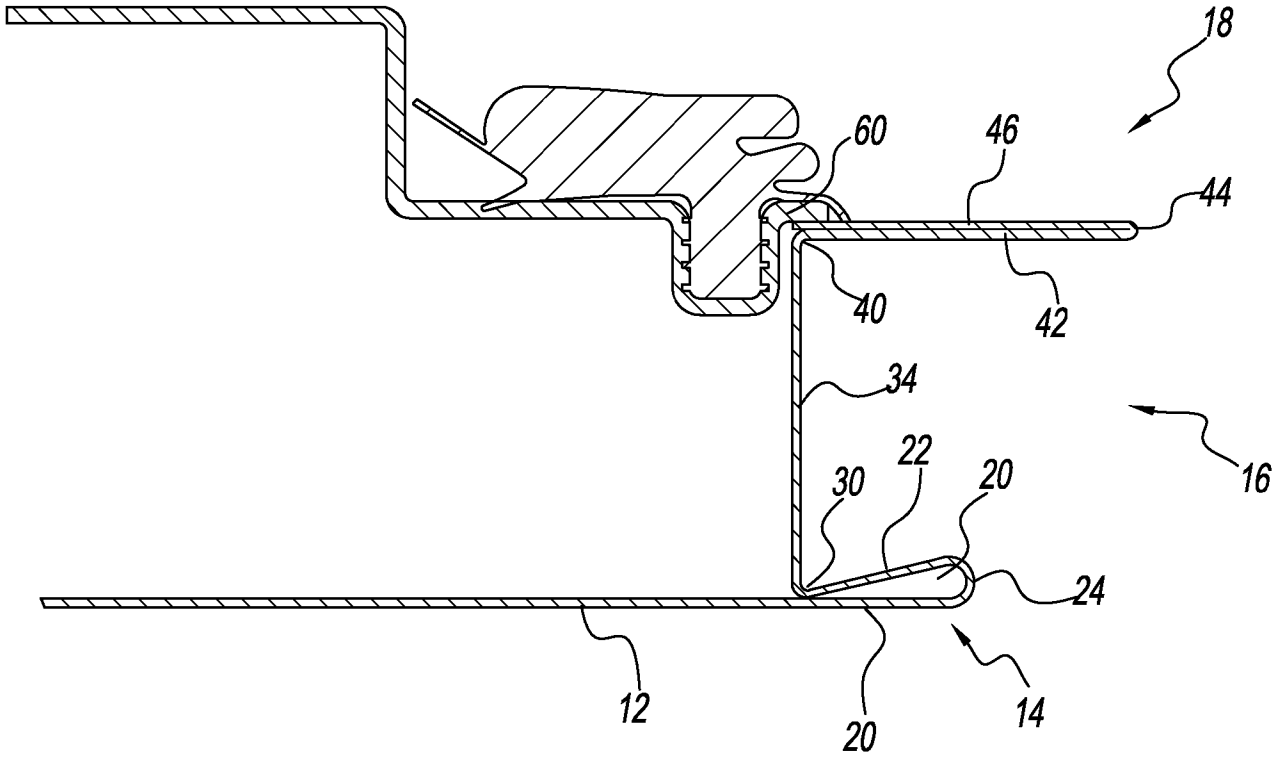
FIG. 3 is top down cross sectional view of the integrated door and handle of FIG. 1.
Figure 4:
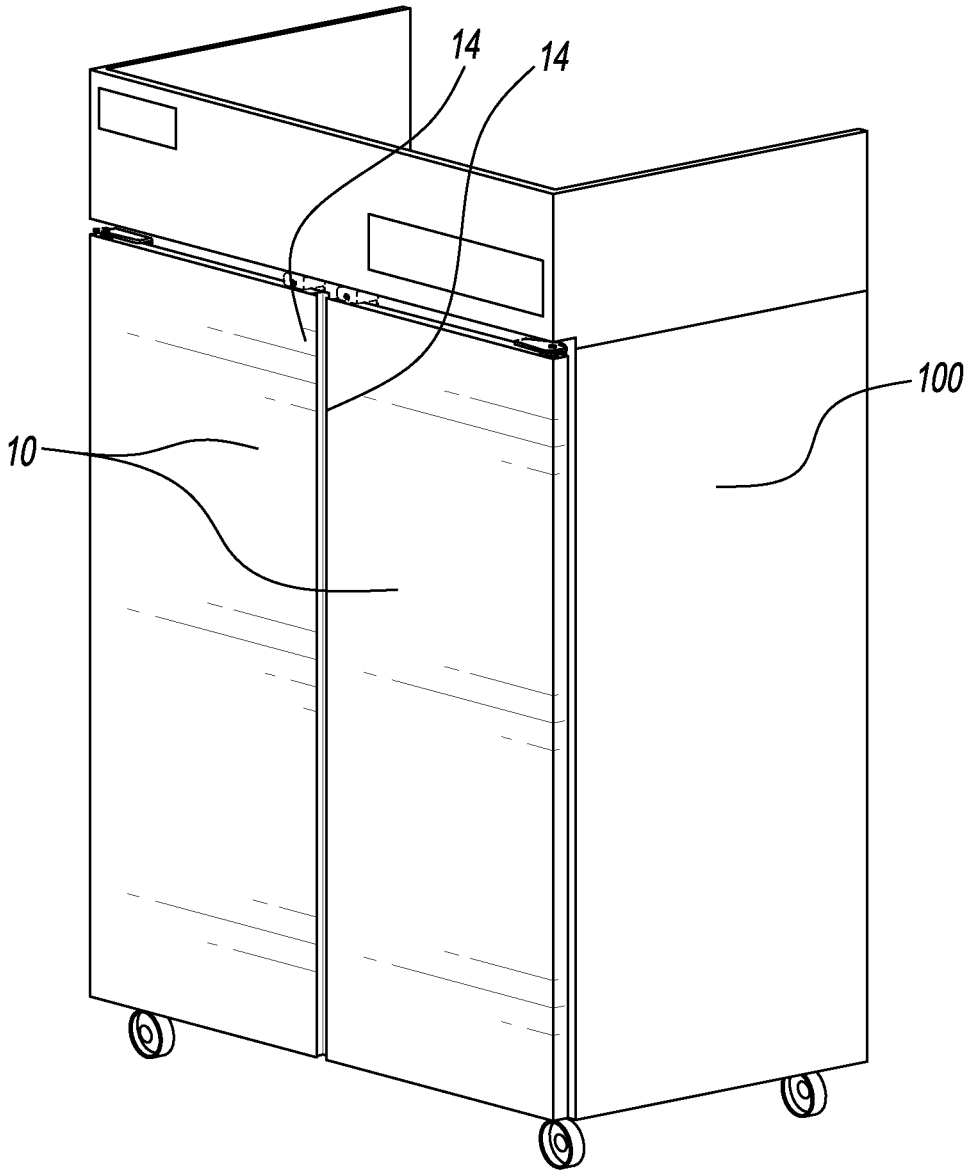
FIG. 4 is a perspective view of a pair of integrated door and handle assemblies shown in a food service cabinet.

Referring to the drawings and, in particular, FIGS. 1-3, there is shown a door or drawer assembly with an integrated handle generally represented by reference numeral 10.

Assembly 10 is formed from a single sheet of metal. Assembly 10 has a front panel 12, a handle 14, a trough 16, and a gasket barrier 18. Front panel 12 is flat.

Handle 14 has a front surface 20, a rear surface 22, and is formed by a tear drop hem 24, creating opening 26. Surface 20 is coplanar and thus flush with front panel 12. Surface 22 contacts the rear of front panel 12 at a bend 30.

Trough 16 is generally "U" shaped and formed between handle 14 and gasket barrier 18, by bends 30 and 40. Trough 16 is has a surface 34 extending from bend 30 and away from front panel 12.

Gasket barrier 18 has a front side 42 formed at bend 40 and rear side 46. Gasket barrier 18 extends from a bend 40 and is formed by a closed hem 44. Front side 42 and rear side 46 are generally parallel.

In a closed position, i.e. the door or drawer assembly being shut, gasket barrier 18 forms a seal with gasket 60.

Surface 34 is generally perpendicular to front panel 12.

Gasket barrier 18 can be parallel to front panel 12.

Handle 14 can have a texture (not shown), preferably on surface 22. Advantageously, a textured surface increases gripability and reduces slippage of a user's hand(s) when the handle is wet or moist.

The texture can be formed of a series of ridges that are preferably parallel to the length of tear drop hem 24. Alternatively, the texture can be ridges perpendicular to the length of tear drop hem 24 or cross hatched ridges. The texture can also be a sandpaper-like texture.

Texturizing, or applying the texture can be achieved by grinding, etching, laser, and the like.

The texture can be etched onto the surface of the metal. Alternatively, handle 14 can have a textured strip adhered to the interior of the handle. Such a strip can be, for example plastic, or metal. The strip is preferably waterproof and/or resistant to movement or dislocation once applied to the interior of the handle. The material for the textured strip is optionally anti-microbial to reduce the transmission of bacteria among users and prevent bacteria and fungus from growing on the surface and/or spreading to other surfaces.

Handle 14 is between 0.25 and 2 inches wide, or at least large enough for a user to grip the handle. Front side 42 of gasket barrier 18 is dimensioned between 0.75 and 3 inches, preferable between 1 and 1.3 inches, and most preferably about 1.15 inches. Surface 20 and rear side 46 are spaced apart by between 1 and 3 inches, preferably between 1.5 and 2 inches, and most preferably about 1.75 inches.

In a preferred embodiment, handle 14 is uniform in cross-section and extends substantially the length of the door/drawer.

A method for forming Assembly 10 is as follows. A single sheet of metal is selected. A first bending forms tear drop hem 24 with surface 20 coplanar to front panel 12 and a surface 22, yielding front panel 12 and handle 14. A second bending at bend 30 creates surface 34. An outside surface of bend 30 can contact an inside surface of front panel 12. A third bending at bend 40 creates surface 42, yielding trough 16. A fourth bending forms closed hem 44, yielding gasket barrier 18 and surface 46.

Referring to FIG. 3, another method for forming Assembly 10 can be as follows. A first 135 degree bend is made at 44 (i.e., closed hem 44). An 88 degree bend is made at 40 (i.e., bend 30). A second 135 degree bend is made at 24 (i.e., tear drop hem 24). A 30 degree bend is made at 44 (i.e., closed hem 44). The first 135 degree bend is flattened to finish tear drop hem 24. The second 135 degree bend is flattened to finish closed hem 44. A 90 degree bend is made at 30 (i.e., bend 30).

Assembly 10 can be made of steel, stainless steel, aluminum, copper, zinc, or the like. Assembly 10 should be made of a material that is easy to keep clean and sanitary.

Advantageously, using stainless steel is generally low maintenance and will prevent assembly 10 from readily corroding, rusting, or staining from water over time. Stainless steel is generally highly resistant to acids and bases. Further, stainless steel is a relatively poor conductor of electricity.

Stainless steel can be easily cleaned with a soft cloth and water, mild detergent, and even glass cleaner.

The steel gauge of assembly 10 can be 8-28 gauge, while most preferably 22 gauge.

Figure 2A:
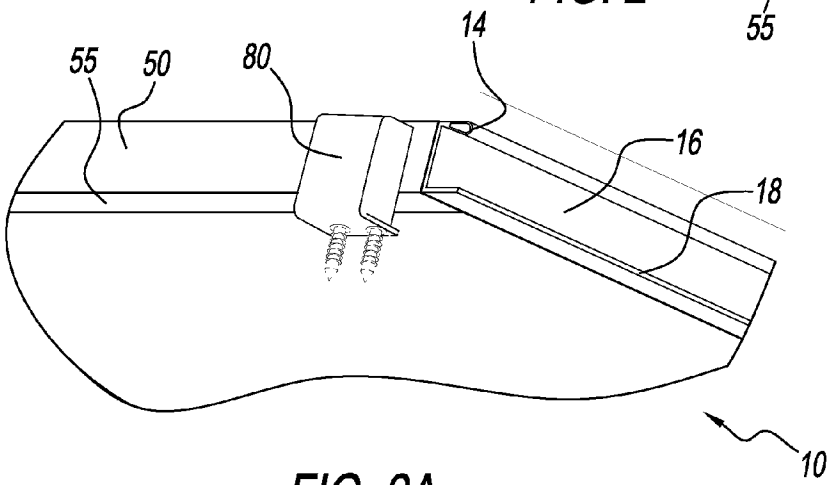
FIG. 2*a* is a detail view of the integrated door and handle as shown in FIG. 2.

As shown in FIGS. 2 and 2*a*, assembly 10 can further include panels 50 and 55, each formed by additional bends 52 and 54 in front panel 12. Panels 50 and 55 can have holes for mounting hardware such as bracket 80, by which assembly 10 can be mounted to a cabinet, drawer, or other structure requiring a door or front drawer panel. A hollow cavity 65 behind front panel 12 is formed.

Figure 5:
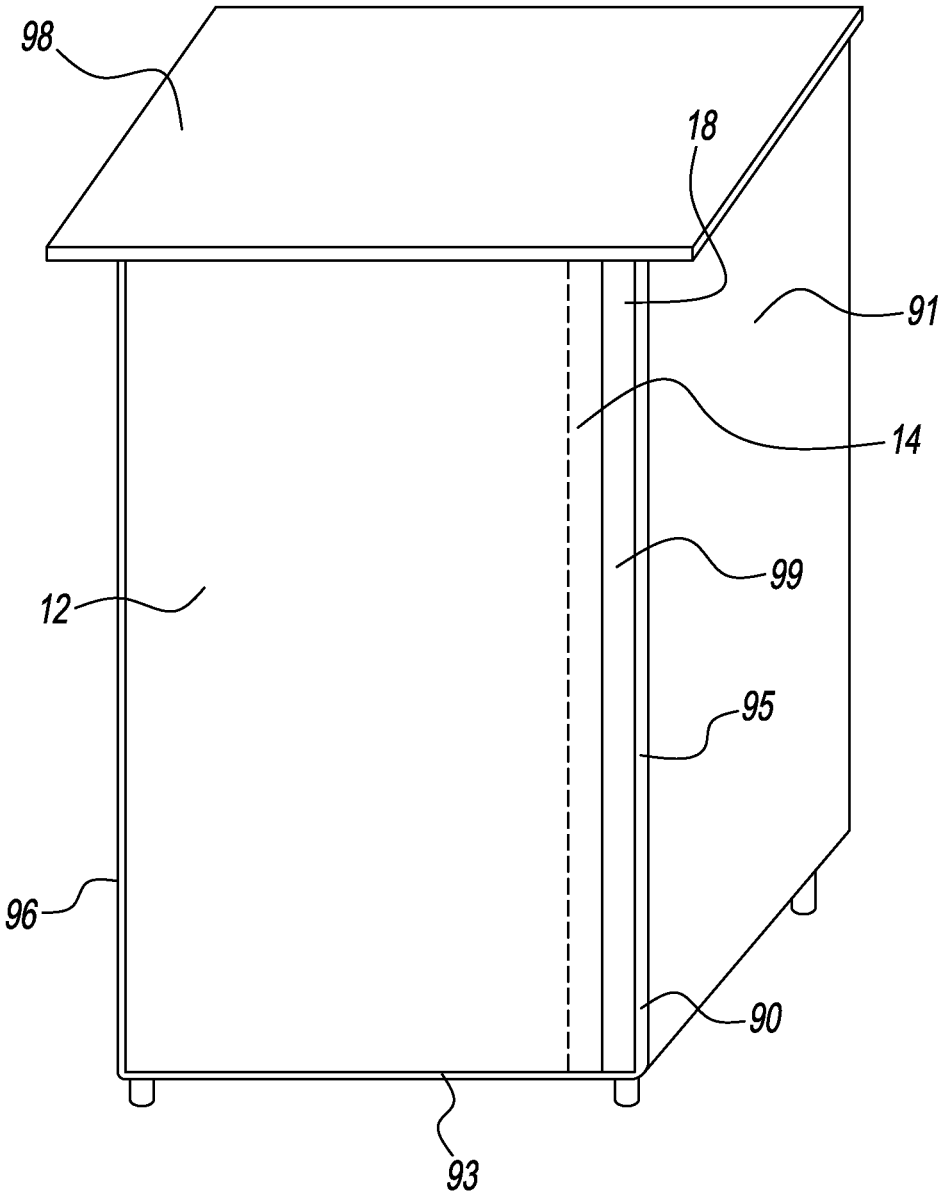
FIG. 5 is a perspective view of a pair of integrated door and handle assemblies shown in another food service cabinet.

Referring now to FIG. 5, there are shown two assemblies 10 and handles 14 in a closed position mounted to a typical food services cabinet 100.

The integrated door/drawer and handle of the present disclosure can be adapted to fit a typical cabinet construction and can be used in a side by side double door arrangement. For example, in a closed position, the gasket barrier of each door forms a boundary or is substantially adjacent with the other. The handles meet each other in the center of the cabinet. Thus the doors can swing and create a single opening.

Referring now to FIG. 6, a preferred embodiment is shown wherein front panel 12 rests flush with a cabinet frame having a border 90. Border 90 can be have a top portion (not shown), bottom portion 93, and/or side portions 95 and 96.

Preferably, border 90 has at least a first and second fixed member 91 and 92, each with a first and second front face 95 and 96.

Front panel 12 can fit flush between first and second fixed members 95 and 96, while a countertop surface 98 extends over the opening in a frontward direction. Thus, the front of the cabinet, i.e., the first front face, second front face, and front panel, is in a single plane with a gap 99 between the handle and the second front face, allowing a user to grip the handle. The gasket barrier 18 rests flush with the second fixed member.

The techniques described herein are exemplary, and should not be construed as implying any particular limitation on the present disclosure. It should be understood that various alternatives, combinations, and modifications could be devised by those skilled in the art from the present disclosure. For example, steps associated with the processes or methods described herein can be performed in any order, unless otherwise specified or dictated by the steps themselves. The present disclosure is intended to embrace all such alternatives, modifications, and variances that fall within the scope of the appended claims.

It is claimed:

1. An integrated door/drawer and handle comprising:

a first side wall having a first end portion and a second end portion; and a second side wall having a first end portion and a second end portion;

wherein said first and second side walls are disposed substantially adjacent to one another and disposed apart from one another by a thickness;

wherein said first end portions of each of said first side wall and said second side wall are substantially adjacent to one another, wherein said second end portion of said first side wall terminates or protrudes beyond said second end portion of said second side wall, thereby forming the handle therebetween, wherein said second side wall has an outer surface that is coplanar to and the same surface as a front panel portion of said door/drawer, and wherein said integrated door/drawer and handle is formed from a single sheet of metal.

2. The integrated door/drawer and handle of claim 1, wherein said second end portion if formed by a closed hem.

3. The integrated door/drawer and handle of claim 1, wherein said first end portion is formed by a teardrop hem.

4. The integrated door/drawer and handle of claim 3, wherein said handle comprises a texture on an interior surface of said handle.

5. The integrated door/drawer and handle of claim 4, wherein said texture is etched, lasered, or ground into said interior surface of said handle.

6. The integrated door/drawer and handle of claim 4, wherein said texture is one texture selected from the group consisting of: a plurality of crosshatches, a plurality of ridges oriented parallel to said tear drop hem, a plurality ridges oriented perpendicular to said teardrop hem, and a sandpaper texture.

7. The integrated door/drawer and handle of claim 4, wherein said texture is a gripable material adhered to said interior surface of said handle.

8. The integrated door/drawer and handle of claim 7, wherein said gripable material is waterproof.

9. The integrated door/drawer and handle of claim 7, wherein said gripable material further comprises an anti-microbial coating.

10. The integrated door/drawer and handle of claim 1, wherein said thickness is large enough for a user's fingers to fit therein.

11. The integrated door/drawer and handle of claim 1, wherein said handle is a continuous surface along a length of said integrated door/drawer and handle.

12. The integrated door/drawer and handle of claim 1, wherein said first side wall further comprises a surface that is continuous along a length of said integrated door/drawer and handle.

13. The integrated door/drawer and handle of claim 1, wherein said single sheet of metal is stainless steel.

14. A method for forming a door/drawer with an integrated handle comprising:

selecting a single sheet panel, wherein said single sheet panel has a front panel surface defining a front panel surface of said door/drawer;

first bending said front panel surface of said door/drawer door to form a first hem, thus yielding said handle having an interior handle surface and outer handle surface; wherein said outer handle surface is coplanar to and the same surface as said front panel surface of said door/drawer;

second bending said interior handle surface thus yielding a trough surface;

third bending said trough surface thus yielding an interior gasket barrier surface; and fourth bending said interior gasket barrier surface with a second hem, thus yielding a gasket barrier, wherein said integrated door/drawer and handle is formed from said single sheet panel.

15. The method of claim 14, wherein said first hem is a teardrop hem.

16. The method of claim 14, wherein said second hem is a closed hem.

17. The method of claim 14, further comprising: applying a textured adhesive strip to said interior handle surface, wherein said interior handle surface is opposite said front panel.

18. The method of claim 14, further comprising: texturizing said interior handle surface, wherein said interior handle surface is opposite said front panel.

19. The method of claim 14, wherein said sheet panel is stainless steel.

20. A cabinet assembly comprising:

an opening in a cabinet defined by a first fixed member having a first front face and a second fixed member having a second front face, wherein said first and second front face are coplanar; and an integrated door/drawer and handle disposed in the opening, the integrated door/drawer and handle having a first side wall having a first end portion and a second end portion and a second side wall having a first end portion and a second end portion;

wherein said first and second side walls are disposed substantially adjacent to one another and disposed apart from one another by a thickness;

wherein said first end portions of each of said first side wall and said second side wall are substantially adjacent to one another, wherein said second end portion of said first side wall terminates or protrudes beyond said second end portion of said second side wall, thereby forming the handle therebetween, wherein said second side wall has an outer surface that is coplanar to and the same surface as a front panel portion of said door/drawer, and wherein said integrated door/drawer and handle is formed from a single sheet of metal.

* * * * *